US009190761B2

(12) United States Patent
Chang

(10) Patent No.: US 9,190,761 B2
(45) Date of Patent: Nov. 17, 2015

(54) CONNECTOR WITH AUDIO PLAYING MODULE

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 175 days.

(21) Appl. No.: 13/684,158

(22) Filed: Nov. 22, 2012

(65) Prior Publication Data

US 2013/0141876 A1 Jun. 6, 2013

(30) Foreign Application Priority Data

Dec. 6, 2011 (TW) ..... 100223002 U

(51) Int. Cl.
*H01R 13/46* (2006.01)
*H01R 13/66* (2006.01)
*H01R 12/72* (2011.01)

(52) U.S. Cl.
CPC ..... *H01R 13/46* (2013.01); *H01R 13/665* (2013.01); *H01R 12/724* (2013.01)

(58) Field of Classification Search
CPC ..... H01R 13/46; H01R 12/724
USPC ..... 361/733, 728, 729, 730
See application file for complete search history.

(56) References Cited

U.S. PATENT DOCUMENTS

| | | | | |
|---|---|---|---|---|
| 5,159,155 | A * | 10/1992 | Nishihara | 174/50 |
| 6,166,892 | A * | 12/2000 | Wu | 361/79 |
| 7,101,230 | B2 * | 9/2006 | Ma | 439/668 |
| 2004/0091124 | A1 * | 5/2004 | Chua et al. | 381/104 |
| 2005/0177661 | A1 * | 8/2005 | Loo | 710/72 |
| 2008/0310667 | A1 * | 12/2008 | Lin et al. | 381/384 |

* cited by examiner

*Primary Examiner* — Dion R Ferguson
*Assistant Examiner* — Mandeep Buttar
(74) *Attorney, Agent, or Firm* — Chun-Ming Shih; HDLS IPR Services

(57) ABSTRACT

A connector with an audio playing module provided for being electrically coupled to a main board of an electronic device includes an insulating base, an audio playing module and a jack. The insulating base has a containing space and a containing groove, and the containing space has an opening, and the containing groove has a port. The audio playing module is contained in the containing space and disposed at a position corresponding to the opening and includes a speaker unit and a plurality of pins, and the speaker unit is electrically coupled to each pin. The jack is contained in the containing groove and disposed at a position corresponding to the port. Therefore, the connector can provide an audio playing effect.

7 Claims, 4 Drawing Sheets

CONNECTOR WITH AUDIO PLAYING MODULE

This application is based on and claims the benefit of Taiwan Application No. 100223002 filed Dec. 6, 2011 the entire disclosure of which is incorporated by reference herein.

FIELD OF THE INVENTION

The present invention relates to a connector, in particular to the connector with an audio playing module.

BACKGROUND OF THE INVENTION

In general, a connector is used for conversions or transmissions between signals or between signals and a power source, and its applications cover a relatively large number of products related to our daily life, military, and aviation. For example, a connection between a mobile phone and a charger, or a connection between a music player and an earphone requires connectors. As science and technology advance, electronic devices usually come with a multifunctional design or require connecting other electronic products to expand its functions. For example, a computer host is connected to a plurality of electronic products such as a mouse, a keyboard, an earphone, a microphone, a Bluetooth device, a screen and a printer at the same time. Obviously, connectors have become a necessary component in our daily life.

A conventional connector comprises an insulating base and a jack, and the insulating base has a containing groove, and the containing groove has a port, wherein the jack is contained in the containing groove and disposed at a position corresponding to the port, and there may be one jack or a plurality of jacks stacked on top of one another or arranged in a row, and the jack can be a high definition multimedia interface (HDMI) port, a DisplayJack port, a universal serial bus (USB) port, a TRS terminal port, a FireWire (IEEE) port, a serial advanced technology attachment (SATA) port, a phono connector (RCA) port or a category 5 cable port provided for connecting various different types of connectors or terminals of the expanded electronic product, so that the electronic device and the electronic product can be connected with each other by the connector to provide transmissions between signals or between signals and a power source, so as to achieve the expanded functions.

However, the conventional connector has the following problems. If it is necessary to connect a large number of expanded electronic products, the host of the electronic device must have many connectors to connect the various desired electronic products to achieve the effects of using and expanding the functions. For example, a computer host requires a large number of connectors to connect other expanded electronic products to achieve the effect of using the computer host fully and successfully. In addition, there is an issue of having too many transmission lines between the expanded electronic products and the computer host, and the transmission lines may be tangled with each other that may give rise to a fire accident. Obviously, the conventional connector requires improvements.

SUMMARY OF THE INVENTION

Therefore, it is a primary objective of the present invention to provide a connector with an audio playing module installed in the connector, and the connector provides an audio playing effect.

To achieve the aforementioned objective, the present invention provides a connector with an audio playing module, comprising an insulating base, an audio playing module and a jack. The insulating base has a containing space and a containing groove, and the containing space has an opening, and the containing groove has a port. The audio playing module is contained in the containing space and disposed at a position corresponding to the opening and includes a speaker unit and a plurality of pins, and the speaker unit is electrically coupled to each pin. The jack is contained in the containing groove and disposed at a position corresponding to the port.

To achieve the aforementioned objective, the present invention further provides a connector with an audio playing module, comprising an insulating base and an audio playing module. The insulating base has a containing space, and the containing space has an opening. The audio playing module is contained in the containing space and disposed at a position corresponding to the opening and includes a speaker unit and a plurality of pins, and the speaker unit is electrically coupled to each pin.

The present invention has the following effects. The speaker unit is installed in the insulating base, so that an external speaker unit is no longer required and the cost of the external speaker unit can be saved. Further, the connector is electrically coupled to the main board of the electronic device, so that the space occupied by the external speaker unit can be saved and used for other purposes. In addition, the quantity of transmission lines can be reduced to achieve the effect of preventing the transmission lines from being tangled with one another and avoiding fire accidents caused by electric leakage.

DESCRIPTION OF THE PREFERRED EMBODIMENTS

The technical contents of the present invention will become apparent with the detailed description of preferred embodiments accompanied with the illustration of related drawings as follows.

Figure 1:
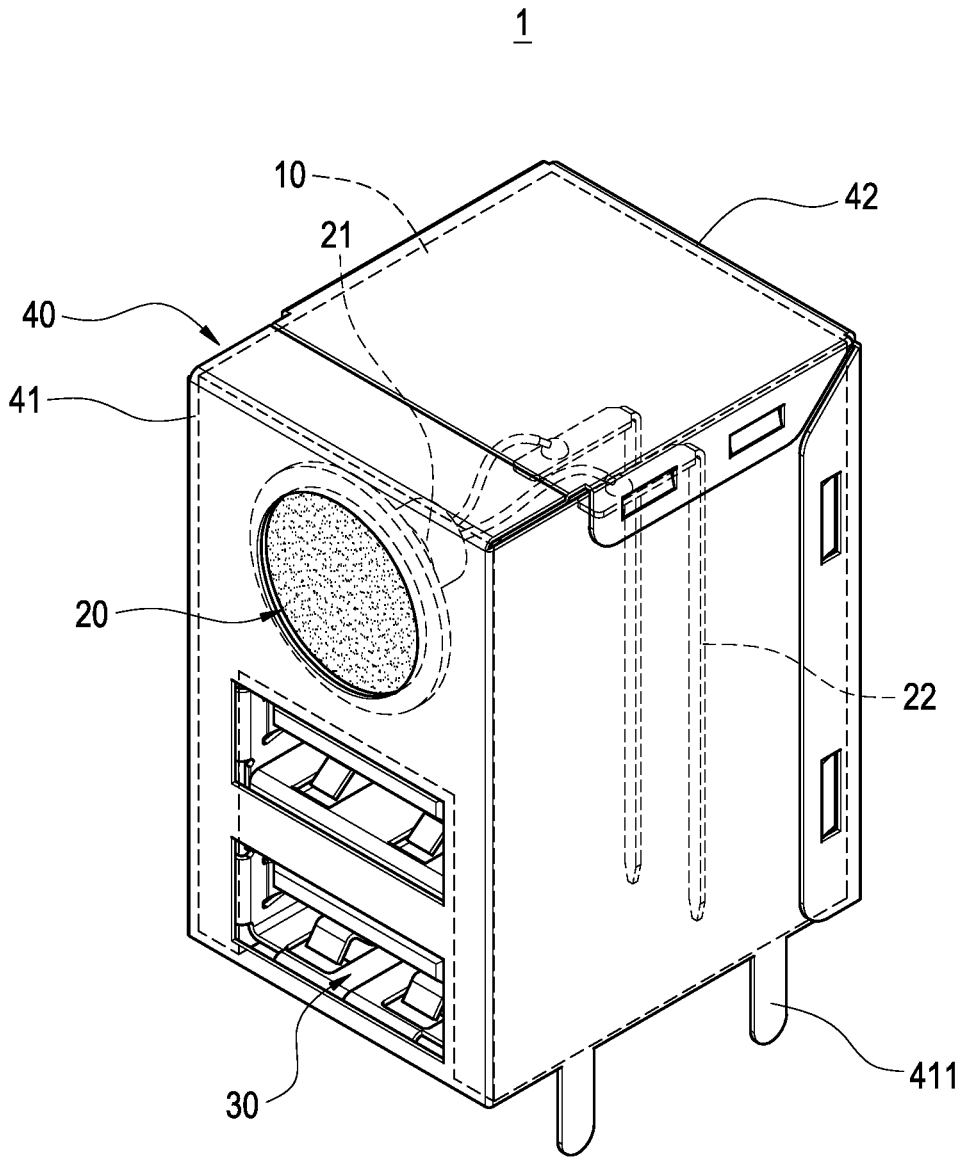
FIG. 1 is a perspective view of a first preferred embodiment of the present invention.
Figure 2:
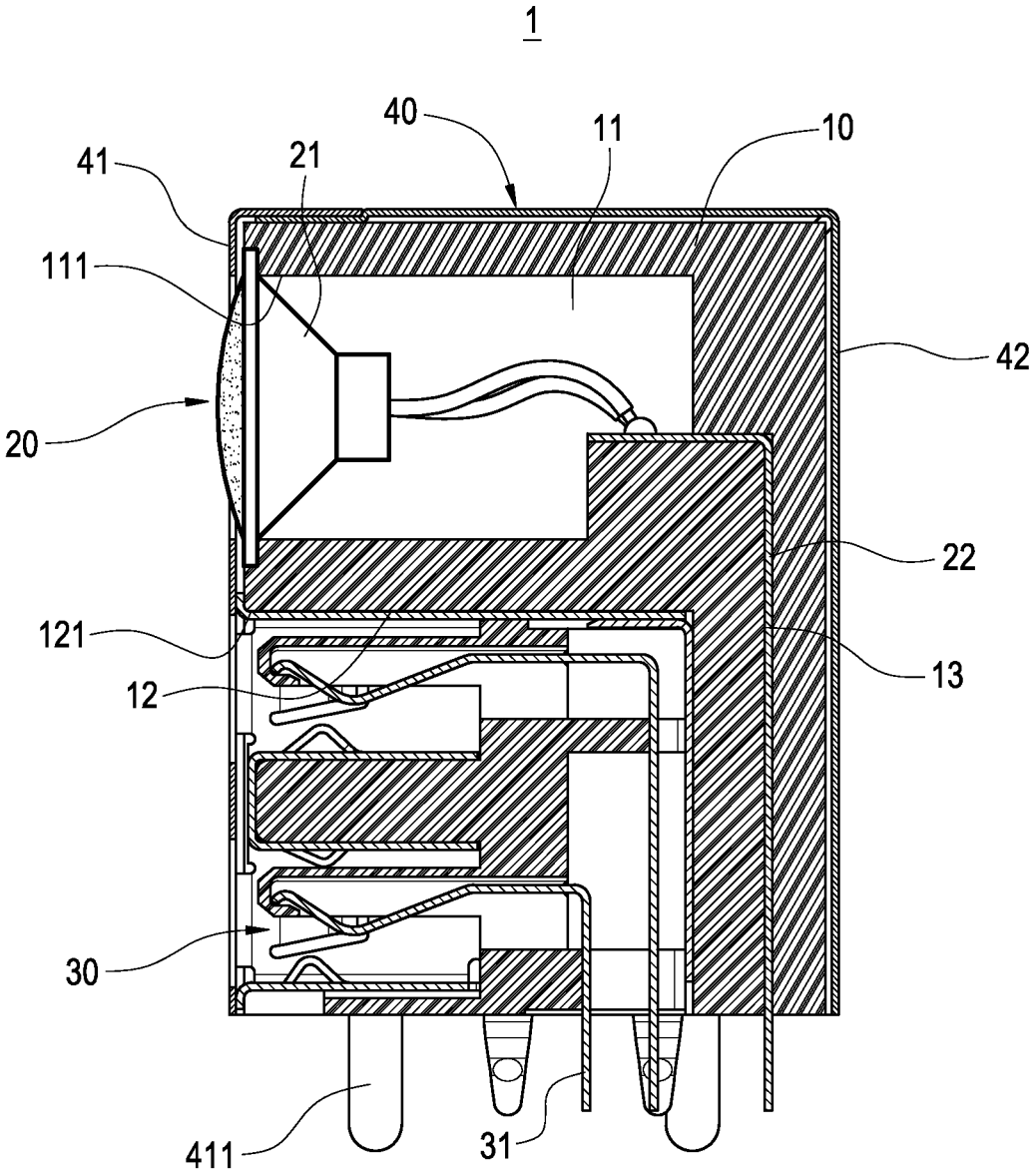
FIG. 2 is a cross-sectional view of the first preferred embodiment of the present invention.

With reference to FIGS. 1 and 2 for a perspective view and a cross-sectional view of a connector with an audio playing module in accordance with a first preferred embodiment of the present invention respectively, the connector with an audio playing module 1 is electrically coupled to a main board 50 of an electronic device and comprises an insulating base 10, an audio playing module 20 and a jack 30.

The insulating base 10 includes a containing space 11, a containing groove 12 and a plurality of pin slots 13. The containing space 11 is formed at the top of the containing groove 12 and has an opening 111, and the containing groove has a port 121. The pin slots 13 are formed in the insulating base 10.

The connector 1 further comprises a metal casing 40 including a front cover 41 and a back cover 42, and the front cover 41 is covered onto a front end of the insulating base 10, and the back cover 42 is covered onto a back end of the insulating base 10 for avoiding electromagnetic interference of the connector 1. The front cover 41 has a fixing footer 411 extended separately from both sides of a bottom plate of the front cover 41 and fixed to the main board 50 for discharging extra static charges, so as to achieve the effect of preventing users from being electrically shock.

The audio playing module 20 is contained in the containing space 11 and disposed at a position corresponding to the opening 111 and includes a speaker unit 21 and a plurality of pins 22, wherein the speaker unit 21 includes but not limited to an electric speaker unit, an electromagnetic speaker unit, a piezoelectric speaker unit or an electrostatic speaker unit, and the speaker unit 21 is electrically coupled to each pin 22, and each pin 22 is passed and fixed into each corresponding pin slot 13, and another pin 22 is extended and passed out from the bottom of the insulating base 10 and electrically coupled to the main board 50.

The jack 30 is contained in the containing groove 12 and disposed at a position corresponding to the port 121 and includes a signal terminal 31 electrically coupled to the main board 50, wherein the jack 30 includes but not limited to a high definition multimedia interface (HDMI) port, a Display-Jack port, a universal serial bus (USB) port, a TRS terminal port, a FireWire (IEEE) port, a serial advanced technology attachment (SATA) port, a phono connector (RCA) port or a category 5 cable port, and there can be one jack 30 or a plurality of jacks 30 stacked on top of one another or arranged in a row.

Figure 3:
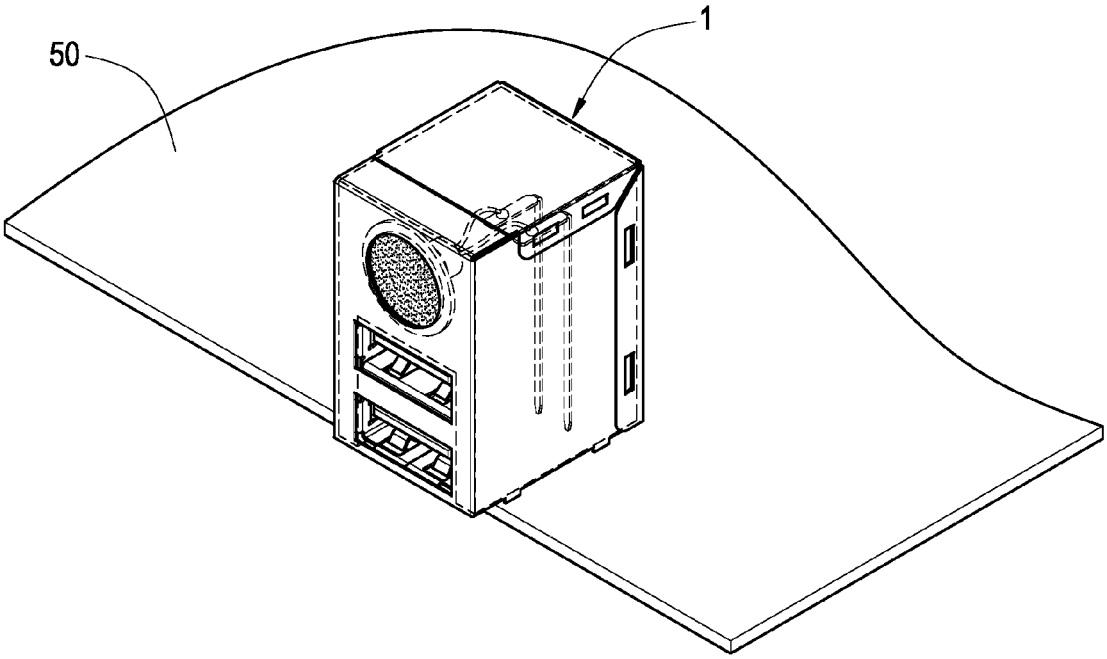
FIG. 3 is a schematic view of a using status of the first preferred embodiment of the present invention.

With reference to FIG. 3 for a schematic view of a using status of the first preferred embodiment of the present invention, the fixing footer 411 on the metal casing 40 of the connector 1 is fixed onto the main board 50 and the signal terminal 31 of the jack 30 and each pin 22 of the audio playing module are electrically coupled to the main board 50 for fixing the connector 1 onto the main board 50, wherein the jack 30 is a universal serial bus (USB) port for externally connecting an external storage device such as a hard disk or a flash memory, so that an audio file stored in the external storage device can be transmitted and saved into a storage unit of the main board 50. If it is necessary to play a music or an audio, then the speaker of the electronic device is turned on, and the audio file stored in the storage unit of the electronic device is transmitted to a control chip of the main board 50 and processed by a program coding, and then transmitted to the audio playing module 20, so that the audio file can be played by the speaker unit 21. In addition, the audio playing module 20 can be coupled to other units on the main board 50 of the electronic device and used as a buzzer.

With the design of the invention, the cost of the external speaker unit can be saved and the space occupied by the external speaker unit can be saved and used for other purposes. Therefore, the quantity of transmission lines between the expanded electronic device and the main board 50 can be reduced to achieve the effects of preventing the transmission lines from being tangled with one another and avoiding fire accidents caused by electric leakage.

Figure 4:
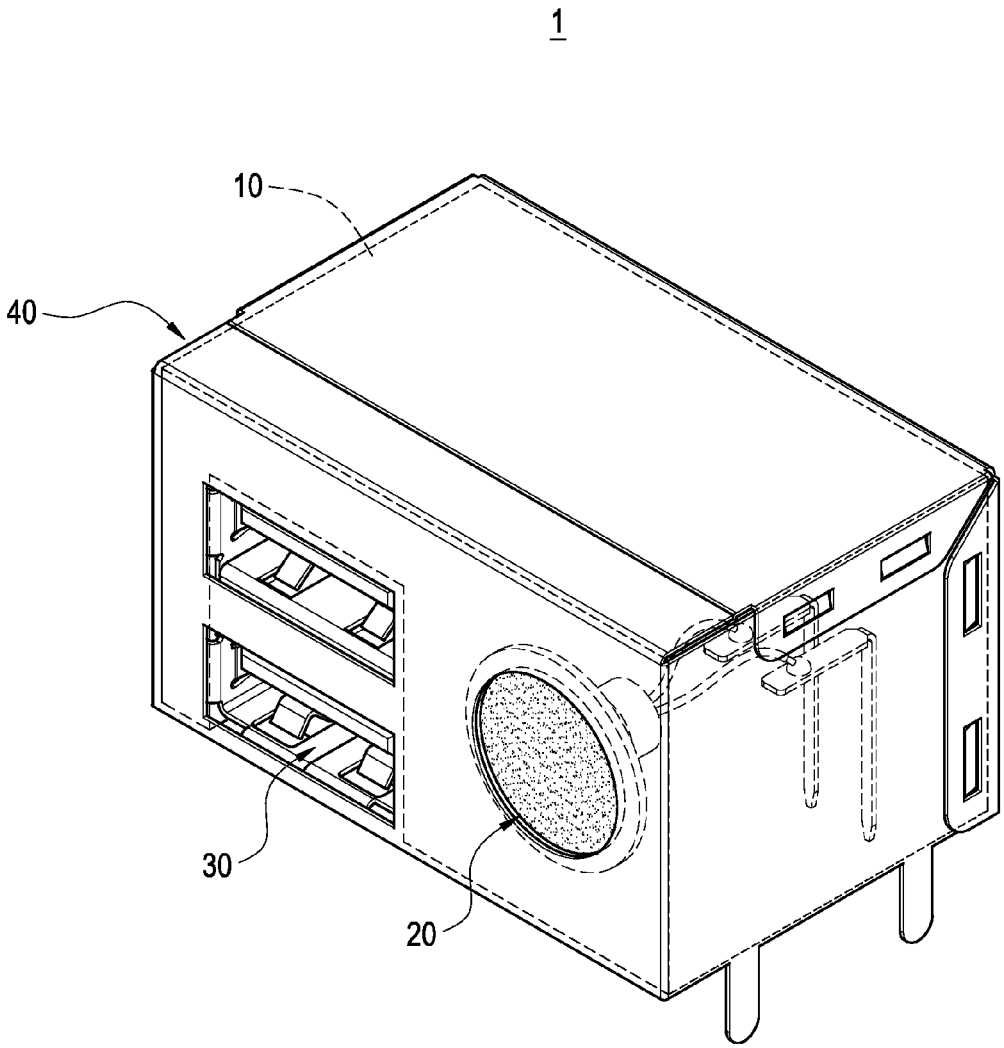
FIG. 4 is a perspective view of a second preferred embodiment of the present invention.

With reference to FIG. 4 for a perspective view of a second preferred embodiment of the present invention, the difference between this preferred embodiment and the previous preferred embodiment resides on that the containing space 11 of the insulating base 10 is formed on a side of the containing groove, so that the audio playing module 20 is installed on a side of the jack 30 to provide diversified ways of arranging the connector 1 and the main board 50.

In summation of the description above, the present invention achieves the expected objectives and overcomes the drawbacks of the prior art as well as complying with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A connector provided for being electrically coupled to a main board of an electronic device, comprising:

an insulating base, having a containing space and a containing groove, and the containing space having an opening, and the containing groove having a port, wherein the opening and the port face a same direction;

a metal casing including a front cover and a back cover;

an audio outputting speaker, contained in the containing space and disposed at a position corresponding to the opening, and including a plurality of pins, and the audio outputting speaker being electrically coupled to each pin; and a jack, contained in the containing groove, and disposed at a position corresponding to the port, wherein the insulating base further includes a top surface, a front surface, a back surface, and two side surfaces; the back cover covers the back surface and the top surface of the insulating base, and the front cover covers the front surface, the two side surfaces, and part of the top surface, and wherein the opening and the port are formed on the front surface; the front cover further covers part of the back cover on the top surface; the front cover on the top surface is aligned with another part of the back cover on the top surface, and wherein the front cover has a fixing footer extended separately from two side surfaces of the front cover and fixed onto the main board.

2. The connector according to claim 1, wherein the insulating base has a plurality of pin slots formed therein, and each pin is passed and fixed into each corresponding pin slot.

3. The connector according to claim 2, wherein each pin is extended and passed out from the bottom of the insulating base and electrically coupled to the main board.

4. The connector according to claim 3, wherein the jack is a high definition multimedia interface (HDMI) port, a Display Jack port, a universal serial bus (USB) port, a TRS terminal port or a FireWire (IEEE) port.

5. A connector provided for being electrically coupled to a main board of an electronic device, comprising:

an insulating base, having a containing space, and the containing space having an opening;

a metal casing including a front cover and a back cover; and an audio outputting speaker, contained in the containing space and disposed at a position corresponding to the opening, and including a plurality of pins, and the audio outputting speaker being electrically coupled to each pin, wherein the insulating base further includes a top surface, a front surface, a back surface, and two side surfaces; the back cover covers the back surface and the top surface of the insulating base, and the front cover covers the front surface, the two side surfaces, and part of the top surface, and wherein the opening is formed on the front surface; the front cover further covers part of the back cover on the top surface; the front cover on the top surface is aligned with another part of the back cover on the top surface, and wherein the front cover has a fixing footer extended separately from two side surfaces of the front cover and fixed onto the main board.

6. The connector according to claim 5, wherein the insulating base has a plurality of pin slots formed therein, and each pin is passed and fixed into each corresponding pin slot.

7. The connector according to claim 6, wherein the pin is extended and passed out from the bottom of the insulating base and electrically coupled to the main board.

* * * * *